US008983096B2

(12) United States Patent
Smith et al.

(10) Patent No.: US 8,983,096 B2
(45) Date of Patent: Mar. 17, 2015

(54) BONE-CONDUCTION PICKUP TRANSDUCER FOR MICROPHONIC APPLICATIONS

(71) Applicant: Apple Inc., Cupertino, CA (US)

(72) Inventors: Wesley S. Smith, Mountain Viiew, CA (US); Henry H. Yang, Los Gatos, CA (US); Esge B. Andersen, Campbell, CA (US); Sorin V. Dusan, San Jose, CA (US); Alexander Kanaris, San Jose, CA (US); Matthew E. Last, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/895,199

(22) Filed: May 15, 2013

(65) Prior Publication Data

US 2014/0072148 A1 Mar. 13, 2014

Related U.S. Application Data

(60) Provisional application No. 61/698,978, filed on Sep. 10, 2012.

(51) Int. Cl.
*H04R 25/00* (2006.01)
*H04R 1/08* (2006.01)
(Continued)

(52) U.S. Cl.
CPC ..... *H04R 1/08* (2013.01); *H04R 1/083* (2013.01); *H04R 1/1083* (2013.01); *H04R 1/46* (2013.01); *H04R 2460/13* (2013.01)
USPC ..... 381/151; 381/328

(58) Field of Classification Search
CPC ..... H04R 2460/13
USPC ..... 381/151, 328
See application file for complete search history.

(56) References Cited

U.S. PATENT DOCUMENTS 3,030,456 A 4/1962 Knauert
(Continued)

FOREIGN PATENT DOCUMENTS

| | | | |
|---|---|---|---|
| EP | 0683621 | A2 | 11/1995 |
| WO | WO-03001847 | A1 | 1/2003 |
| WO | WO-03015465 | A1 | 2/2003 |

OTHER PUBLICATIONS

"BMA280 Digital, Triaxial Acceleration Sensor", Produce Information, Bosch Sensortec, Doc. No. BST-BMA280-FL000-00, Version 0.9, 102011, (2 pages).

Henry, Paula, "Bone Conduction: Anatomy, Physiology, and Communication", ARL-TR-4138, May 2007, Army Research Laboratory, Aberdeen Proving Ground, MD 21005-5425, (Whole Document).

(Continued)

*Primary Examiner* — Ahmad F Matar
*Assistant Examiner* — Norman Yu
(74) *Attorney, Agent, or Firm* — Blakely, Sokoloff, Taylor & Zafman LLP

(57) ABSTRACT

A personal audio device has a bone conduction pickup transducer, having a housing of which a rigid outer wall has an opening formed therein. A volume of yielding material fills the opening in the rigid outer wall. An electronic vibration sensing element is embedded in the volume of yielding material. The housing is shaped, and the opening is located, so that the volume of yielding material comes into contact with an ear or cheek of a user who is using the personal audio device. Other embodiments are also described and claimed.

25 Claims, 4 Drawing Sheets

(51) Int. Cl.
*H04R 1/10* (2006.01)
*H04R 1/46* (2006.01)

(56) References Cited

U.S. PATENT DOCUMENTS

| | | | | |
|---|---|---|---|---|
| 5,298,692 | A | 3/1994 | Ikeda et al. | |
| 5,692,059 | A | 11/1997 | Kruger | |
| 6,560,468 | B1 | 5/2003 | Boesen | |
| 6,647,345 | B2 * | 11/2003 | Bye et al. | 702/57 |
| 6,681,022 | B1 * | 1/2004 | Puthuff et al. | 381/338 |
| 8,130,984 | B2 | 3/2012 | Asseily et al. | |
| 8,213,645 | B2 | 7/2012 | Rye et al. | |
| 8,688,174 | B2 * | 4/2014 | Latham et al. | 455/569.1 |
| 2010/0172519 | A1 | 7/2010 | Kimura | |
| 2010/0246860 | A1 * | 9/2010 | Rye et al. | 381/151 |
| 2010/0260364 | A1 * | 10/2010 | Merks | 381/313 |
| 2011/0135120 | A1 | 6/2011 | Larsen et al. | |

OTHER PUBLICATIONS

Matic, Aleksandar, "Speech Activity Detection Using Accelerometer", 34 Annual International Conference of the IEEE, EMBS, San Diego, California, USA, Aug. 28-Sep. 1, 2012, (pp. 2112-2115).

Park, Woo-Tae, "Fully Encapsulated Sub-Millimeter Accelerometers", Micro Electro Mechanical Systems, 2005, MEMS 2005, 18th IEEE International Conference, Jan. 30-Feb. 3, 2005, ISBN: 0-7803-8732-5, (pp. 347-350).

Walter, Patrick L., "The History of the Accelerometer", 1920s-1996—Prologue and Epilogue, 2006, Sound and Vibration, Jan. 2007, (pp. 84-92).

PCT Invitation to Pay Additional Fees (dated Nov. 21, 2013), International Application No. PCT/US2013/055754, International Filing Date—Aug. 20, 2013, (6 pages).

PCT Search Report and Written Opinion (dated Jan. 14, 2014), International Application No. PCT/US2013/055754, International Filing Date—Aug. 20, 2013, (17 pages).

* cited by examiner

BONE-CONDUCTION PICKUP TRANSDUCER FOR MICROPHONIC APPLICATIONS

RELATED MATTERS

This application claims the benefit of the earlier filing date of provisional application No. 61/698,978, filed Sep. 10, 2012, entitled "Bone-Conduction Pickup Transducer for Microphonic Applications".

FIELD

An embodiment of the invention is a bone-conduction pickup or vibration transducer designed for microphonic applications such as voice activity detection, speech enhancement, and other non-microphonic applications. Other embodiments are also described.

BACKGROUND

Voice communication systems and speech recognition systems typically use acoustic microphones to pickup a user's speech via the sound waves produced by the user talking. The speech is then converted into digital form and used in various types of digital signal processing applications, including voice activity detection for the purposes of noise suppression, speech enhancement, and user interfaces that are based on voice recognition inputs.

An in-the-ear microphone system has been suggested which simultaneously uses both a bone and tissue vibration sensing transducer (to respond to bone-conducted lower speech frequency voice sounds) and a band limited acoustical microphone (to detect the weaker airborne higher speech frequency sounds) within the ear canal. Such a technique allegedly improves speech intelligibility, which is particularly useful for voice recognition systems. The vibration sensing transducer can be an accelerometer, which can be mounted firmly to the inside wall of the housing of an earphone by an appropriate cement or glue, or by a friction fit.

SUMMARY

A personal audio device is described that has a bone conduction pickup transducer. The transducer has a housing of which a rigid outer wall has an opening formed therein. A volume of soft or yielding material fills the opening in the rigid outer wall. An electronic vibration sensing element, such as an accelerometer, is embedded in the volume of yielding material. The housing is shaped, and the opening is located, so that the volume of yielding material comes into contact with an ear or cheek of a user who is using the personal audio device. In such an arrangement, the vibration sensing element can provide an output signal that is indicative of the user's voice, via sensing bone conduction vibrations that have been transmitted through the user's ear or cheek and into the yielding material. The output signal may then be used by digital audio processing functions during a telephony or multi-media playback, such as voice activity detection, speech recognition, active noise control and noise suppression.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1A:
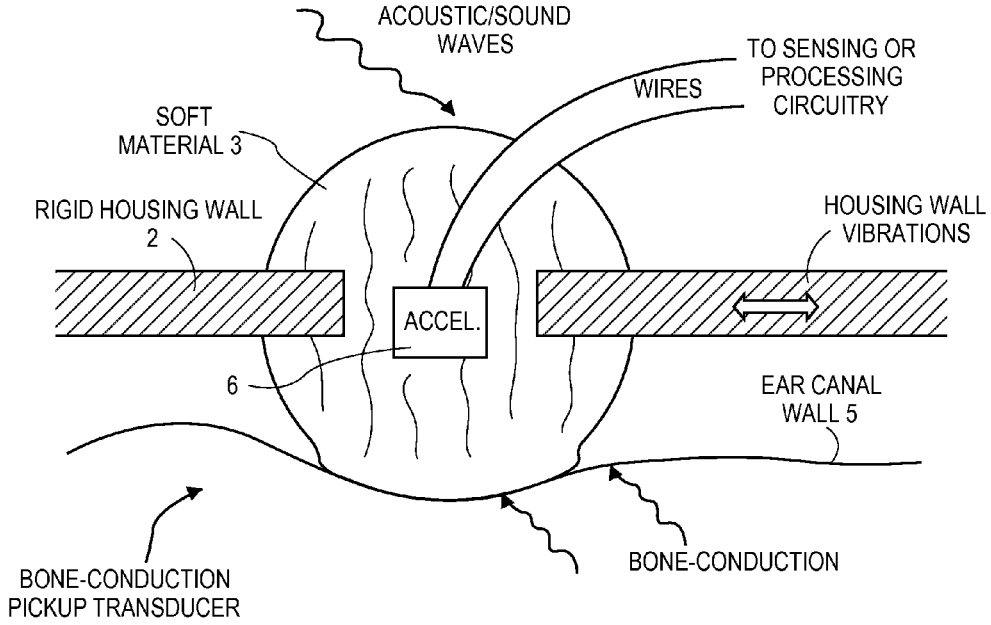
FIG. 1A shows a cross-section elevation view of part of a personal audio device in which a bone-conduction pickup transducer has been installed.

FIG. 1A shows a cross-section elevation view of a personal audio device in which a bone-conduction pickup transducer has been formed. The transducer has, or may be built within, a rigid housing of which a rigid outer wall 2 is depicted. The housing wall may be that of an earphone housing (see FIG. 3) or another personal listening device (see FIG. 4). An opening is formed in the housing wall as shown, where this opening is filled with a volume of soft or yielding material 3. The housing is shaped such that it allows the volume of soft material 3 therein to be in contact with an ear canal wall 5 of a wearer or user of the device. As seen in FIG. 1A, the volume of soft material 3 may fill the entire hole or opening within the housing wall 2. Embedded within the soft material is an electronic vibration sensing element referred to here as an accelerometer 6 in a general sense; it may alternatively be another suitable inertial sensor. The accelerometer may be a device that measures linear acceleration and outputs an electrical signal which may be an analog signal that represents the detected acceleration of a proof mass (not shown) within the accelerometer 6. Conventional accelerometers are used to detect gravity (in units of g, where 1 g=9.8 meters/$s^2$). In this case, the accelerometer may be optimized or customized to produce an output signal that is indicative of the user's voice, via sensing bone-conduction vibrations through contact with the ear canal wall 5 as shown. More specifically, bone-conduction vibrations are transmitted through the ear canal wall 5 and into the soft material 3 which conveys the vibrations to the accelerometer 6 where they are sensed.

Figure 2:
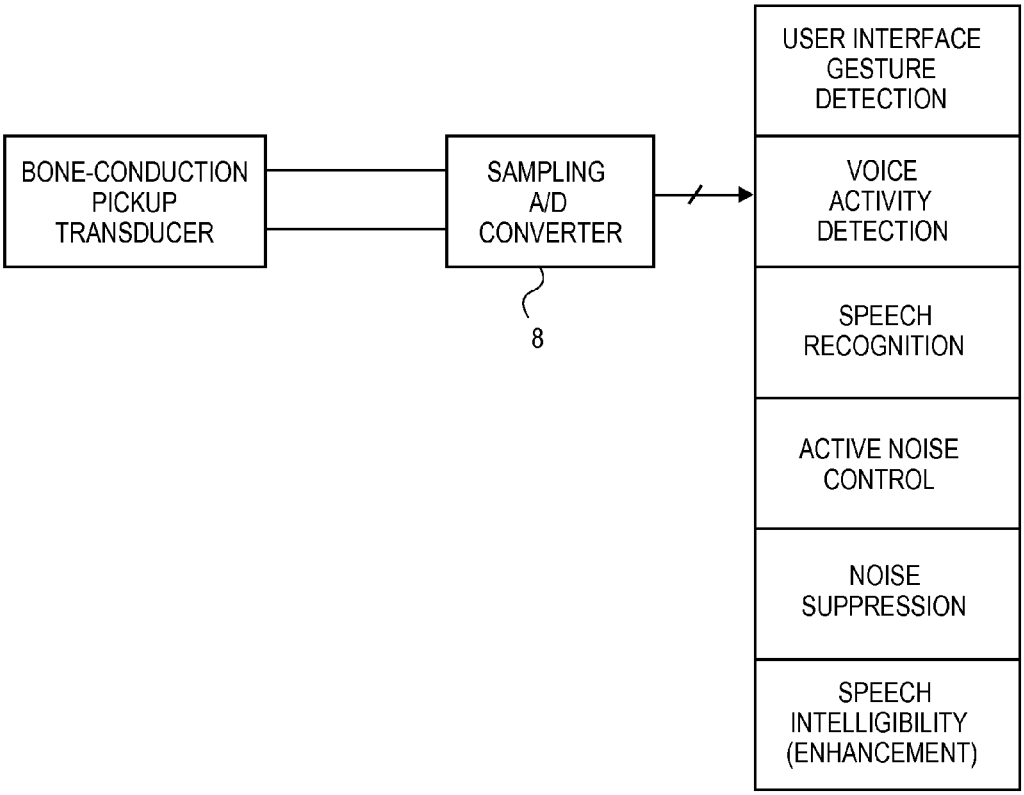
FIG. 2 is a block diagram of a microphonic application of the bone-conduction pickup transducer.

As seen in FIG. 2, the output signal provided by the bone-conduction pickup transducer, which initially may be assumed to be an analog signal produced by the accelerometer 6, may be sampled by an A/D converter 8, and then converted into digital form. The accelerometer circuitry may be incorporated within the accelerometer package itself, or it may be located in a separate electronics housing (e.g., outside the soft material but inside the earphone housing, or in a housing that contains a digital processor 10 and that is attached to some point along the accessory cable which is plugged into a portable audio host device 12—see FIG. 3). This digital bitstream may then be used by any one of several different audio processing functions (also referred to as higher layer audio processing functions) such as voice activity detection, speech recognition, active noise control, and noise suppression. These audio processing functions may in turn be used by even higher layer functionality, namely telephony or multi-media applications including voice and video phone calls, audio recording and playback, and speech recognition driven user interfaces. The higher layer audio processing functions are typically performed by a digital processor that is located within a housing of the host audio device 12.

It should also be noted that while FIG. 2 shows only the output of the bone-conduction pickup transducer being fed to the various audio processing blocks, additional information may accompany the bone-conduction bitstream, including an output signal from one or more acoustic microphones, and other sensors including, for example, a proximity sensor and an ambient light sensor. Personal listening devices such as smart phones and tablet computers have a variety of such sensors whose outputs may be combined with the output of the bone-conduction pickup transducer, in the various audio processing blocks. For example, a decision can be made as to whether to turn on or turn off (mute) an acoustic microphone that is integrated within a headset, in response to detecting the wearer's voice through the bone-conduction pickup transducer. This gating function allows the system to mute or attenuate the signal from the acoustic microphone when the user is not talking, to thereby reduce background noise being picked up by the acoustic microphone.

As explained above, an accelerometer 6 is used as part of a bone-conduction pickup device, such that vibrations generated by the user's vocal cords that are conducted through the skull and that shake the ear canal wall can be sensed by the accelerometer. At the same time, the accelerometer, and the transducer package as a whole, should be designed to reject ambient acoustic noise that is transmitted through the air (this is depicted as acoustic/sound waves in FIG. 1A). In addition to rejecting the ambient acoustic or sound noise, the pickup transducer should also be designed to reject vibrations or shaking of the housing wall. Thus, while the accelerometer 6 itself should be reliably mounted to the housing, by being embedded within the soft material 3 as shown, the soft material 3 may be sufficiently pliant so as to dampen any shaking or vibrations that are arriving through the housing wall 2. At the same time, the material 3 should be able to enhance the transmission of vibrations from bone conduction, through its contact with the ear canal wall 5. To meet these two conflicting requirements, namely to decouple vibrations through the housing wall but enhance the coupling of vibrations through the ear canal wall, a suitably soft material should be chosen in which to embed the accelerometer. For example, in order to index match or impedance match with the ear canal wall, a very soft material (human flesh-like or tissue-like hardness and texture) is desirable. As an example, a suitable silicone material may be used that exhibits a hardness score of less than 10 Shore A, or, for example, an extra soft material having a hardness of less than 20 Shore 00. Other possible materials include neoprene, nitrile and latex.

A further consideration for the bone-conduction pickup transducer is that the accelerometer 6 will have sensitivity and offset that may have significant temperature coefficients (temperature variability). As such, the accelerometer 6 should be mounted in a way that provides relatively good thermal conduction, so as to be able to dissipate heat, e.g. either through the housing wall 2 or directly to the ear canal wall 5.

Ideally, the accelerometer 6 should be in direct contact with the ear canal 5. But this may not be achievable in practical sense, and as such the use of a certain volume of the soft material 3 in which the accelerometer 6 is embedded is described here. While the soft material 3 should dampen any vibrations caused by, for example, shaking of the housing, while at the same time provide a good index matching with human tissue or flesh being the ear canal wall, it should also be designed to dampen the acoustic or sound waves that will likely be present on one or both sides of the housing as shown. In particular, the outside of the housing receives ambient acoustic noise, whereas the inside of the housing may receive acoustic waves that are produced by a nearby sound emitting transducer, namely an earpiece speaker driver or receiver 15—see FIG. 3. It is desirable that the volume of soft material 3 be able to minimize any coupling to the sound waves that are generated by the driver 15. As such, it is also desirable that the accelerometer 6 be positioned, and in particular, the opening in which the soft material 3 is formed as shown in FIG. 1A should be located, so as to make relatively strong contact with the ear canal wall 5 of the wearer.

In addition, the receiver or driver 15 (FIG. 3) should be acoustically isolated from the accelerometer 6. An acoustically isolating suspension should be used for mounting the driver 15 to the inside of the earphone housing, and the accelerometer 6 should also be mechanically isolated from the driver 15. In addition, acoustic mismatch between the accelerometer 6 and the air or region inside the earphone housing should also be maximized. This may be accomplished by adding appropriate dampening material, between the accelerometer, and in particular between the soft material in which the accelerometer 6 is embedded, and the speaker driver 15. As another example, a sound barrier such as a horn may be constructed to isolate the accelerometer, perhaps in addition to the soft material, where such a sound barrier also helps to direct the sound being produced by the speaker driver 15 out through the primary acoustic port opening.

Figure 3:
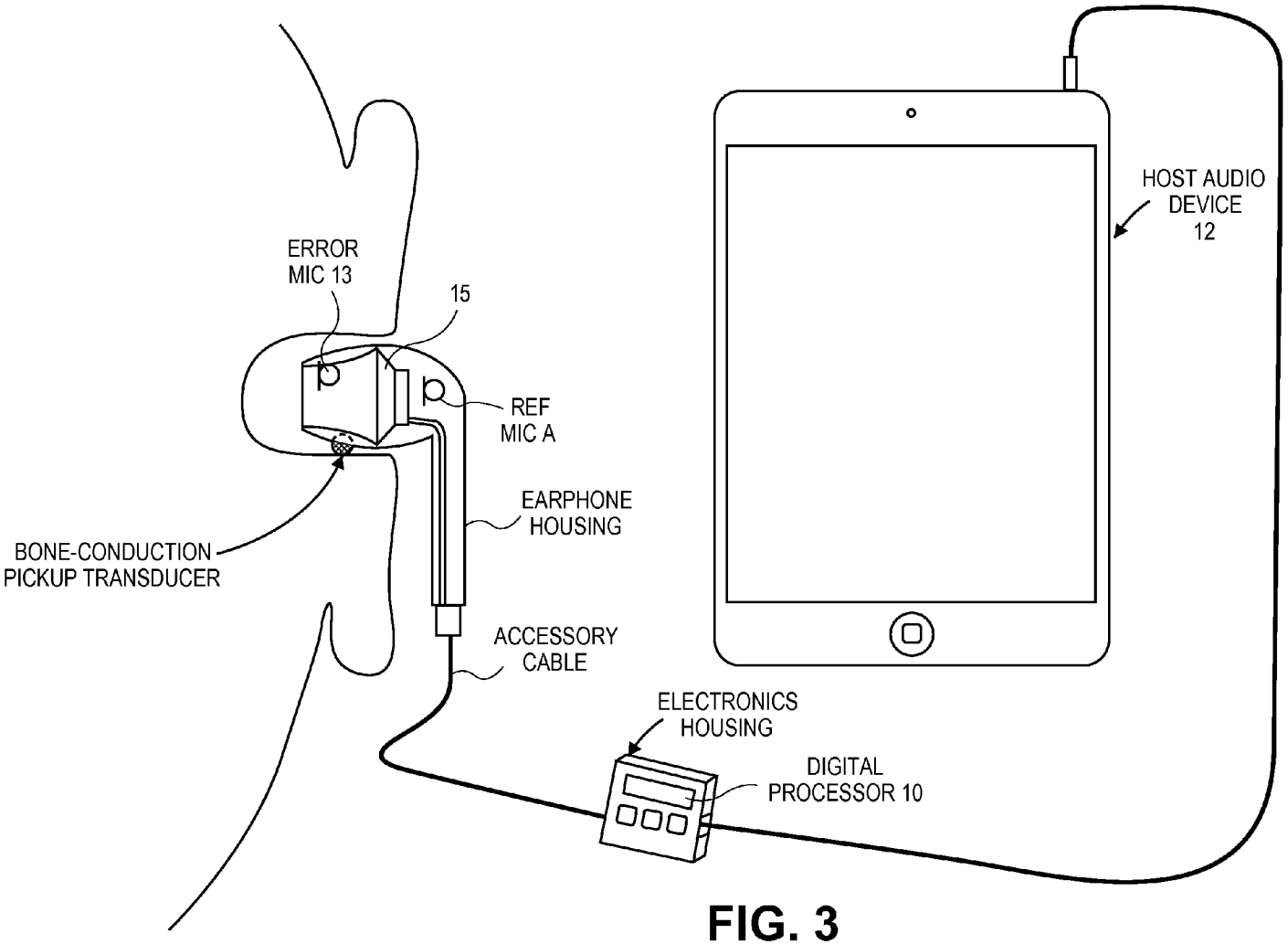
FIG. 3 shows an example of a personal listening device in which the bone-conduction pickup transducer may be used.

In one embodiment, the accelerometer should be sufficiently small so that it can be positioned within an opening in the housing wall 2 (see FIG. 1A), where this may be the housing of an ear bud-type earphone—see FIG. 3. Such a location also allows good contact with the ear canal wall 5 (once the earphone has been inserted into the wearer's ear). Conventional accelerometer implementations are currently in the form of a micro electromechanical system (MEMS) mass-spring-damper system.

In one embodiment, the mass-spring-damper system should be designed so that any resonances are outside of the expected operating range of the accelerometer. For the microphonic applications contemplated here, the accelerometer is expected to produce meaningful output signals up to 3 kHz, and perhaps up to 4 kHz, so the resonances should be well above this range. This also means that the sampling by the A/D converter should be at a sufficiently high frequency, to reduce the effects of aliasing. As a result, it is expected that the A/D conversion sampling frequency should be upwards of 8 kHz.

Figure 1B:
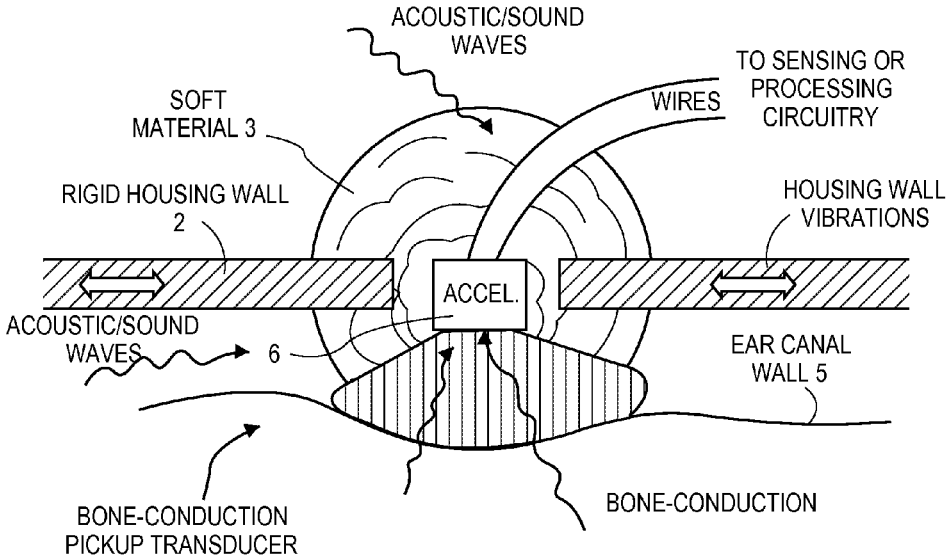
FIG. 1B shows another bone-conduction pickup transducer.

FIG. 1B shows the case where the volume of soft material in which the accelerometer is embedded may have different sections, where one section is of a material that is designed to enhance mechanical vibration coupling to the ear canal wall, whereas the other section is designed to suppress, that is absorb or reflect, both sound waves coming though the air and vibrations coming through the housing wall. There may also be partition walls (not shown) formed between sections.

Figure 4:
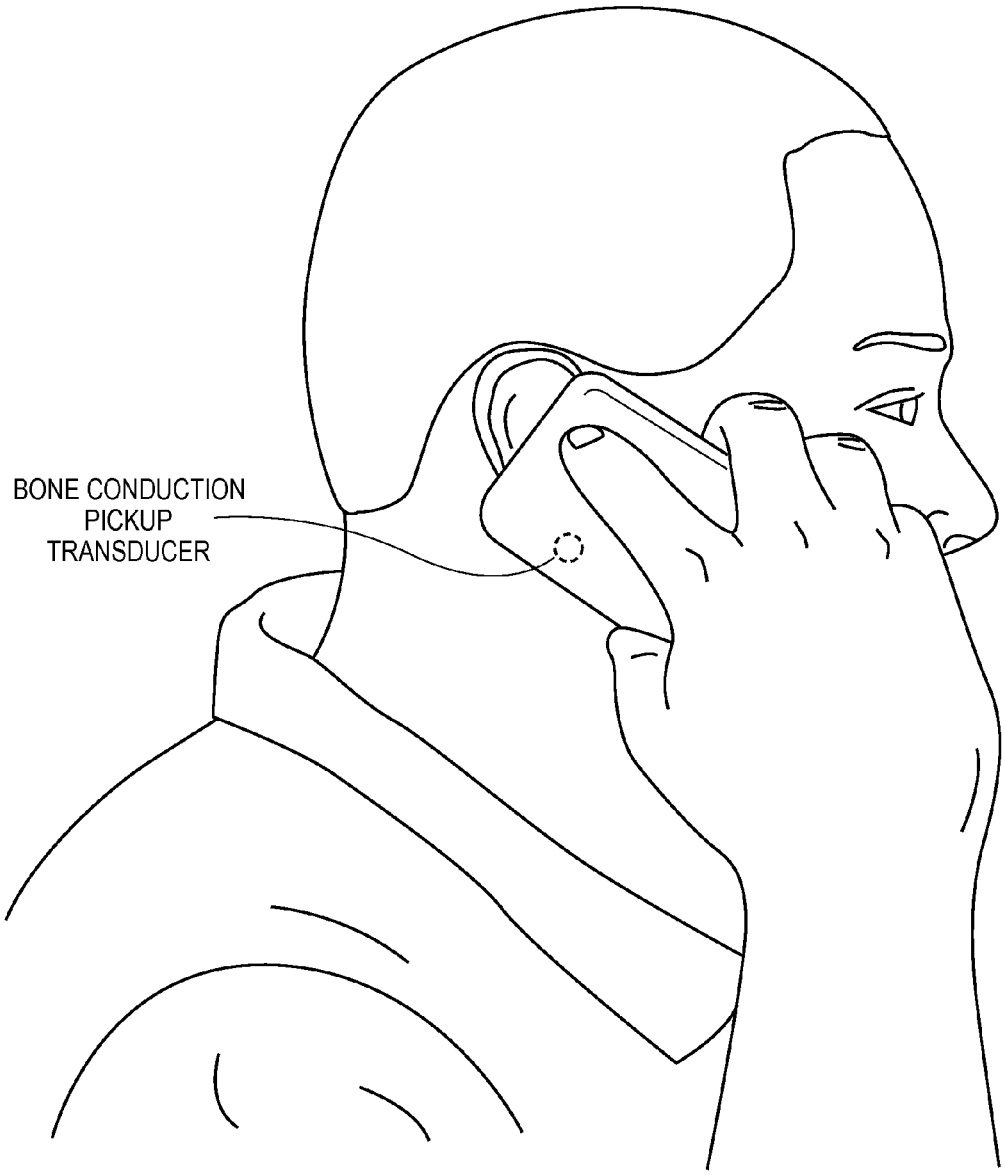
FIG. 4 shows another example of a personal listening device in which the bone conduction pickup transducer may be used.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the listening device depicted in FIG. 3 is a headset and host audio device combination, the bone-conduction pickup transducer could also be implemented in the housing wall of a smart phone or cellular phone handset as shown in FIG. 4. In that case, however, rather than contacting the ear canal wall, the volume of soft material in which the accelerometer is embedded would be positioned for contacting an outer-ear region or a cheekbone region (or cheek) of the user. The description is thus to be regarded as illustrative instead of limiting.

What is claimed is:

1. A personal audio device comprising:

a housing of which a rigid outer wall has an opening formed therein that that extends from a face of the wall, through the wall and out of an opposite face of the wall;

a sound emitting transducer held inside the housing that is to receive an audio signal; and a bone conduction pickup transducer having a volume of yielding material that fills the opening in the rigid outer wall; and an electronic vibration sensing element comprising an accelerometer embedded in the volume of yielding material, wherein the housing is shaped, and the opening is located, so that the volume of yielding material comes into contact with an ear or cheek of a user who is using the personal audio device.

2. The device of claim 1 wherein the housing is an in-ear earphone housing in which the vibration sensing element and the volume of yielding material are held, the device further comprising an acoustic microphone held inside the housing.

3. The device of claim 2 further comprising an electronics accessory cable that is coupled to the vibration sensing element to transfer a vibration signal to an audio source device, and is coupled to the sound emitting transducer to deliver said audio signal from the audio source device.

4. The device of claim 1 wherein the housing is a mobile phone handset housing in which the vibration sensing element and the volume of yielding material are held.

5. The device of claim 1 wherein the volume of yielding material comprises two sections of different material, one of which extends inward of the housing wall and another lies outward of the housing wall.

6. The device of claim 5 wherein one of the two sections of the volume of yielding material is made of a material that enhances mechanical vibration coupling to the user's ear or cheek, while another is made of a material that absorbs or reflects sound waves coming through the air and vibrations coming through the housing wall.

7. The device of claim 2 further comprising an acoustically isolating suspension for mounting the sound emitting transducer to the inside of the housing.

8. A personal audio device comprising:

a headset having a headset housing inside of which a sound emitting transducer that is to receive an audio signal is held, and a bone conduction pickup transducer, the bone conduction pickup transducer comprising a volume of yielding material that fills an opening formed in a rigid outer wall of the headset housing that extends from a face of the wall, through the wall and out of an opposite face of the wall, and an electronic vibration sensing element comprising an accelerometer embedded in the volume of yielding material, wherein the headset housing is shaped, and the opening is located, so that the volume of yielding material comes into contact with an ear of a user who is wearing the headset.

9. The personal audio device of claim 8 further comprising an accessory cable connected at one end to the headset housing, wherein the cable is to be connected at another end to a host audio device from which the audio signal is to be delivered to the sound emitting transducer.

10. The personal audio device of claim 8 further comprising an acoustic microphone, wherein the headset housing is that of an earbud type earphone inside which the acoustic microphone is held.

11. The personal audio device of claim 8 wherein the electronic vibration sensing element comprises a MEMS spring-damper system whose resonance frequency lies outside an operating range of the bone conduction pickup transducer.

12. The personal audio device of claim 11 wherein the resonance frequency is higher than 3 kHz.

13. The personal audio device of claim 8 wherein the volume of yielding material comprises two sections of different material, one of which extends inward of the housing wall and another that extends outward of the housing wall.

14. The personal audio device of claim 13 wherein one of the two sections of the volume of yielding material is made of a material that enhances mechanical vibration coupling to the user's ear, while another is made of a material that absorbs or reflects sound waves coming through the air and vibrations coming through the housing wall.

15. The personal audio device of claim 8 further comprising:

an acoustically isolating suspension for mounting the sound emitting transducer to the inside of the housing.

16. A personal audio device comprising:

a bone conduction audio pickup transducer having a housing of which a rigid outer wall has an opening formed therein, a volume of yielding material fills the opening in the rigid outer wall, and an electronic vibration sensing element embedded in the volume of yielding material, wherein the housing is shaped, and the opening is located, so that the volume of yielding material comes into contact with an ear canal wall of a user who is using the personal audio device, and the yielding material can decouple vibrations through the housing wall while enhancing coupling of vibrations through the ear canal wall.

17. The personal audio device of claim 16 wherein the yielding material has a human flesh-like or human tissue like hardness and texture that to better impedance match with the ear canal wall.

18. The personal audio device of claim 17 wherein the yielding material has a hardness score of less than 10 Shore A.

19. The personal audio device of claim 18 wherein the yielding material has a hardness score of less than 20 Shore 00.

20. The personal audio device of claim 16 wherein the yielding material has a hardness score of less than 10 Shore A.

21. The personal audio device of claim 2 further comprising dampening material between a) the volume of yielding material in which the accelerometer is embedded and b) the sound emitting transducer, to increase acoustic mismatch between the accelerometer and air inside the housing.

22. The personal audio device of claim 1 wherein the accelerometer is positioned within the opening of the outer wall of the housing.

23. The personal audio device of claim 2 wherein the accelerometer is positioned within the opening of the outer wall of the housing.

24. The device of claim 2 wherein the volume of yielding material comprises two sections of different material, one of which extends inward of the housing wall and another lies outward of the housing wall.

25. The personal audio device of claim 10 wherein the electronic vibration sensing element comprises a MEMS spring-damper system whose resonance frequency lies outside an operating range of the bone conduction pickup transducer.

* * * * *